US009867460B2

(12) United States Patent
Haskins et al.

(10) Patent No.: US 9,867,460 B2
(45) Date of Patent: Jan. 16, 2018

(54) ADJUSTABLE LAP TABLE

(71) Applicants: Joyce Copeland Haskins, Johns Creek, GA (US); Jeffery Lee Morgan, Kennesaw, GA (US); Joshua M. Taylor, Bluffton, SC (US); William J. Haskins, Johns Creek, GA (US)

(72) Inventors: Joyce Copeland Haskins, Johns Creek, GA (US); Jeffery Lee Morgan, Kennesaw, GA (US); Joshua M. Taylor, Bluffton, SC (US); William J. Haskins, Johns Creek, GA (US)

( * ) Notice: Subject to any disclaimer, the term of this patent is extended or adjusted under 35 U.S.C. 154(b) by 0 days.

(21) Appl. No.: 15/446,063

(22) Filed: Mar. 1, 2017

(65) Prior Publication Data

US 2017/0251807 A1 Sep. 7, 2017

Related U.S. Application Data

(60) Provisional application No. 62/389,522, filed on Mar. 1, 2016.

(51) Int. Cl.

| | |
|---|---|
| ***A47B 23/00*** | (2006.01) |
| ***A47B 3/10*** | (2006.01) |
| ***A47B 13/08*** | (2006.01) |
| ***A47B 9/16*** | (2006.01) |

(52) U.S. Cl.

CPC ..... *A47B 23/002* (2013.01); *A47B 3/10* (2013.01); *A47B 9/16* (2013.01); *A47B 13/083* (2013.01); *A47B 2200/0042* (2013.01); *A47B 2200/0043* (2013.01)

(58) Field of Classification Search

CPC ..... A47B 23/002; A47B 9/00; A47B 9/16; A47B 13/02; A47B 13/083; A47B 17/02; A47B 17/065; A47B 2200/0042; A47B 2200/0043

See application file for complete search history.

(56) References Cited

U.S. PATENT DOCUMENTS

| | | | | |
|---|---|---|---|---|
| 5,809,901 | A * | 9/1998 | Gutzmer | A47B 13/083 108/27 |
| 6,010,158 | A | 1/2000 | Croteau | |
| 6,378,831 | B1 * | 4/2002 | Copeland, Jr. | A47B 13/083 108/27 |
| 8,651,446 | B2 | 2/2014 | Lausell | |
| 8,672,374 | B1 | 3/2014 | Webber | |
| 8,885,338 | B1 | 11/2014 | Simpson | |
| 8,985,333 | B1 | 3/2015 | Clementi | |
| 9,145,158 | B2 | 9/2015 | Cruz | |
| 9,163,779 | B2 | 10/2015 | Funk | |

(Continued)

*Primary Examiner* — Daniel J Rohrhoff

(74) *Attorney, Agent, or Firm* — Crose Law LLC; Bradley D. Crose

(57) ABSTRACT

An adjustable lap table, being collapsible, rotatable, and adjustable in three dimensions includes: a base, generally planar in shape and configured for placement upon a user's lap or other flat surface without any additional mounting hardware; a platform generally planar in shape and configured for receipt of an electronic device or book, and configured for use at a plurality of angles, orientations, and rotations relative to the base of the lap table; and an adjustment column assembly disposed between the base and the platform and coupled to the base and the platform, thereby to provide a means to adjust the lap table in three dimensions.

19 Claims, 9 Drawing Sheets

(56) References Cited

U.S. PATENT DOCUMENTS

| | | | | |
|---|---|---|---|---|
| 9,360,892 | B2 | 6/2016 | Heckler | |
| 9,364,081 | B1 | 6/2016 | Haymond | |
| 9,388,939 | B2 | 7/2016 | Girault | |
| 9,448,588 | B2 | 9/2016 | Barnard | |
| 9,459,664 | B2 | 10/2016 | Varadarajan | |
| 9,486,910 | B2 | 11/2016 | Stevens | |
| 2011/0219988 | A1* | 9/2011 | Stephens | A47B 9/00 108/6 |
| 2013/0139736 | A1* | 6/2013 | Flaherty | A47B 9/18 108/106 |
| 2016/0007734 | A1* | 1/2016 | Suman | A47B 23/043 108/26 |
| 2016/0106239 | A1* | 4/2016 | Iulita | A47B 13/083 273/309 |
| 2016/0270526 | A1* | 9/2016 | Siemer | F16M 11/38 |
| 2017/0049224 | A1* | 2/2017 | Kim | A47B 21/02 |

* cited by examiner

ADJUSTABLE LAP TABLE

CROSS-REFERENCE TO RELATED APPLICATION(S)

The present non-provisional patent application claims the benefit of priority of U.S. Provisional Patent Application No. 62/389,522 which is entitled "ADJUSTABLE LAP TABLE", which was filed on Mar. 1, 2016, and which is incorporated in full by reference herein.

FIELD OF THE INVENTION

The technology described herein relates generally to devices such as computer stands, computer holders, lap tables, electronic device holders, tablet stands, and so forth, for holding an electronic device, portable computer, or the like. More specifically, this technology relates to a lap table that is adjustable and collapsible. Furthermore, this technology relates to an adjustable lap table that is adjustable in three dimensions and includes a top portion that is rotatable 360 degrees.

BACKGROUND OF THE INVENTION

There are known in the background art a variety of different devices and systems such as computer stands, computer holders, food tables, lap tables, electronic device holders, tablet stands, and so forth, for holding an electronic device, portable computer, or the like. However, there remain many shortcomings and deficiencies in the known background art. Known attempts to address these and related problems are enumerated below.

Related utility patents known in the art include the following:

- U.S. Pat. No. 9,145,158, issued to Cruz on Sep. 29, 2015, discloses a tablet computer holder.
- U.S. Pat. No. 9,459,664, issued to Varadarajan et. al. on Oct. 4, 2016, discloses a portable computing device having a movable stand.
- U.S. Pat. No. 9,448,588, issued to Barnard on Sep. 20, 2016, discloses an electronic device holder.
- U.S. Pat. No. 9,388,939, issued to Girault on Jul. 12, 2016, discloses multi-media tablet holder comprising a pivotable and rotatable ratchet mount, a lighting device and a handle including a user input touch screen.
- U.S. Pat. No. 9,364,081, issued to Haymond et. al. on Jun. 14, 2016, discloses a foldable tablet stand.
- U.S. Pat. No. 9,360,892, issued to Heckler on Jun. 7, 2016, discloses a tablet computer stand.
- U.S. Pat. No. 9,163,779, issued to Funk et. al. on Oct. 20, 2015, discloses a tablet mounting systems, stands, and methods.
- U.S. Pat. No. 8,985,333, issued to Clementi on Mar. 24, 2015, discloses an adjustable tablet holder.
- U.S. Pat. No. 8,651,446, issued to Lausell on Feb. 18, 2014, discloses a PC tablet holder and method of use thereof.
- U.S. Pat. No. 8,672,374, issued to Webber on Mar. 18, 2014, discloses a holder for tablet computer.
- U.S. Pat. No. 8,885,338, issued to Simpson et. al. on Nov. 11, 2014, discloses a computer tablet holder.
- U.S. Pat. No. 9,486,910, issued to Stevens et. al. on Nov. 8, 2016, discloses a tablet computer holder.
- U.S. Pat. No. 6,010,158, issued to Croteau on Jan. 4, 2000, discloses a collapsible work station device.

As should be apparent to one of ordinary skill in the art, upon reading this disclosure, these many known attempts to address such problems regarding computer stands, computer holders, food tables, lap tables, electronic device holders, tablet stands, and so forth, include many shortcomings and deficiencies.

The foregoing patent and other information reflect the state of the art of which the inventor is aware and are tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides an adjustable and collapsible lap table. The lap table is adjustable in three dimensions and includes a top portion that is rotatable 360 degrees. The lap table is designed to accommodate and receive an electronic device, portable computer, e-reader, phone, or the like.

In various embodiments, the adjustable lap table has a rectangular surface with a center pedestal. The center pedestal is adjustable in multiple directions: up and down; forward and backward; and a top surface that can be pivoted to be flat or horizontal, or at any diagonal to suit the preference of a user. The top surface also can be rotated 360 degrees in either direction. The adjustable lap table includes a rectangular base with dimensions similar to the top. Polymer bands wrap around the edges of the top and bottom to prevent the base from sliding. Additionally, the polymer band on the top includes a lip to keep an electronic device contained upon the top platform. It at least one embodiment, there is no polymer band on the base. The polymer band may be rubber, silicone, composite, or like material.

In one exemplary embodiment, the technology described herein provides an adjustable lap table being collapsible, rotatable, and adjustable in three dimensions. The adjustable lap table includes: a base, generally planar in shape and configured for placement upon a user's lap or other flat surface without any additional mounting hardware; a platform generally planar in shape and configured for receipt of an electronic device or book, and configured for use at a plurality of angles, orientations, and rotations relative to the base of the lap table; and an adjustment column assembly disposed between the base and the platform and coupled to the base and the platform, thereby to provide a means to adjust the lap table in three dimensions.

In at least one embodiment, the adjustable lap table further includes a platform protective band disposed about an outer circumference of the platform to provide a soft edge of the platform.

In at least one embodiment, the adjustable lap table also includes a lip disposed upon a top edge of the platform protective band to form a tray on a top surface of the platform and to provide an edge against which an item on the platform is maintained.

In at least one embodiment, the adjustment column assembly also includes a base pivot post disposed upon a top surface of the base; and a base pivot post channel disposed within the base pivot post in a generally horizontal arrangement and to provide a first axis about which the lap table is adjustable.

In at least one embodiment, the adjustment column assembly further includes a platform post disposed upon a bottom surface of the platform; a rotational disc having a disc aperture in a center portion; and a platform post aperture disposed within the platform post in a generally vertical arrangement and to provide a second axis about which the lap table is adjustable, thereby to provide 360 degrees of rotation of the platform about the second axis.

In at least one embodiment, the adjustment column assembly also includes a platform pivot post, disposed immediately below the platform post; a platform pivot post horizontal channel disposed within the platform pivot post in a generally horizontal arrangement and to provide a third axis about which the lap table is adjustable; and a platform pivot post vertical channel disposed with the platform pivot post in a generally vertical arrangement and to provide a means to couple the platform pivot post to the platform post and maintain rotation about both the second axis and the third axis.

In at least one embodiment, the adjustment column assembly further includes a bolt disposed through the platform pivot post vertical channel to secure the platform pivot post to the platform post in a manner than allows full 360-degree rotation of the platform post, and the platform upon the platform post about the second axis.

In at least one alternative embodiment, the adjustment column assembly includes, instead of the bolt and disc means of attachment: a platform post disposed upon a bottom surface of the platform; a platform post magnet channel disposed within the platform post in a generally vertical arrangement and to provide a second axis about which the lap table is adjustable, thereby to provide 360 degrees of rotation of the platform about the second axis; a platform post magnet disposed at least partially within the platform post magnet channel; a platform pivot post, disposed immediately below the platform post; a platform pivot post horizontal channel disposed within the platform pivot post in a generally horizontal arrangement and to provide a third axis about which the lap table is adjustable; and a platform pivot post magnet channel disposed with the platform pivot post in a generally vertical arrangement and to provide a means to couple the platform pivot post to the platform post and maintain rotation about both the second axis and the third axis; and a platform pivot post magnet disposed at least partially within the platform pivot post magnet channel; wherein the platform post magnet and the platform pivot post magnet are magnetically and removably coupled to one another, yet allow for rotation.

In at least one embodiment, the adjustment column assembly is collapsible for ease in transport and to minimize space utilized.

In at least one embodiment, the adjustment column assembly provides adjustability in three dimensions to include: front to back; flat to pitched, and up and down.

In at least one embodiment, the adjustment column assembly further includes a left plate; a right plate; and a plurality of apertures disposed through each of the left plate and the right plate. The left plate and the right plate are disposed about the left and right sides of both the base pivot post and the platform pivot post, respectively, and wherein through the plates and apertures the first knob post and second knob post, respectively, are received.

In at least one embodiment, the base and platform are wood.

In at least one embodiment, the base and platform are injection molded plastic.

In at least one embodiment, the one or more components of the adjustment column assembly is injection molded plastic.

In at least one embodiment, the platform protective band is a polymer.

Advantageously, the technology described herein provides an adjustable lap table that is convenient to a user to hold an electronic device in a comfortable position. Also, advantageously, the adjustable lap table is adjustable in three dimensions. Also, advantageously, the adjustable lap table is lightweight and easily collapsible, such that it is easy to store and pack when traveling. Further advantageously, the adjustable lap table include polymer bands that add stability and prevent the unit and the device used with it from slipping off.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Figure 1A:
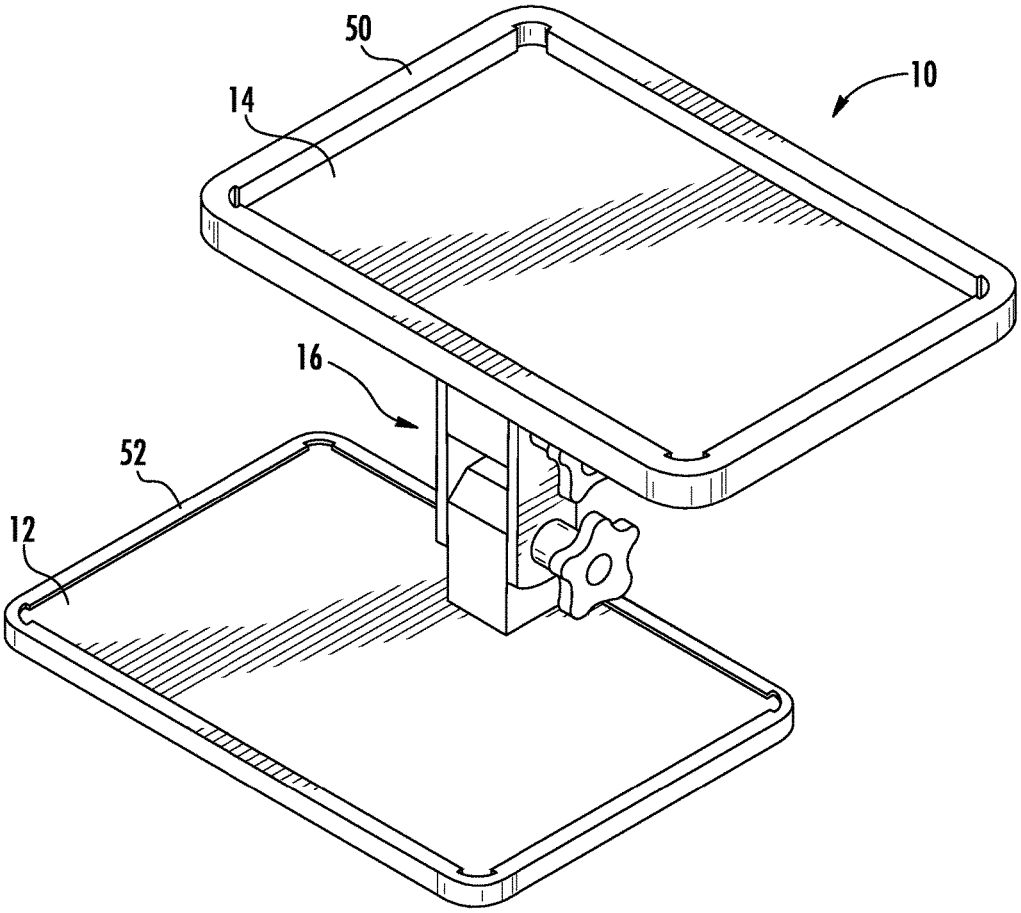
FIG. 1A is a front perspective view of an adjustable lap table, as viewed generally from the left front, illustrating, in particular, a base, a platform upon which to place a tablet, or the like, and an adjustment column, according to an embodiment of the technology described herein.
Figure 1B:
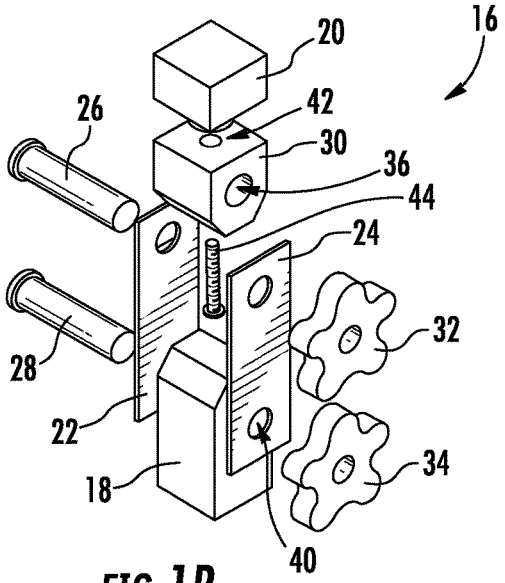
FIG. 1B is an expanded perspective view of the adjustment column depicted in FIG. 1A, illustrating, in particular, the base pivot post, platform post, platform pivot post, connecting plates, and knob assemblies, according to an embodiment of the technology described herein.
Figure 2A:
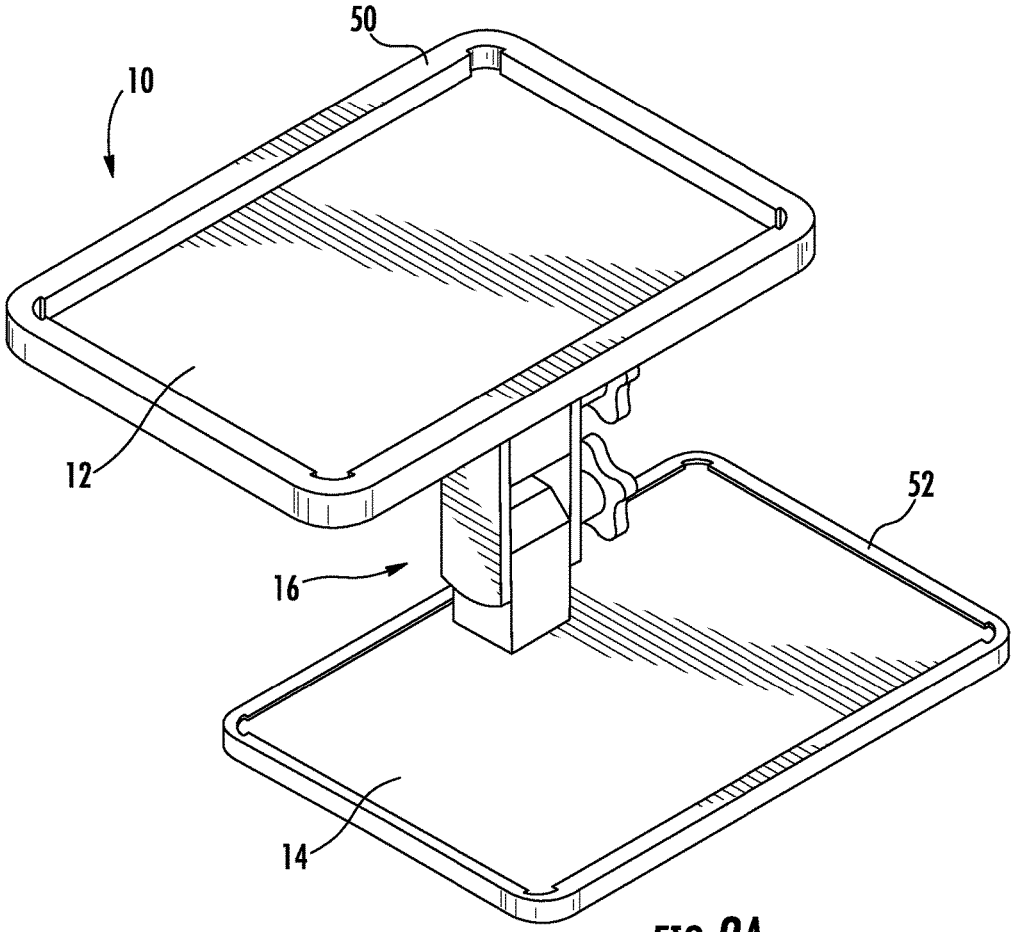
FIG. 2A is a front perspective view of an adjustable lap table, as viewed generally from the right front, illustrating, in particular, a base, a platform upon which to place a tablet, or the like, and an adjustment column, according to an embodiment of the technology described herein.
Figure 2B:
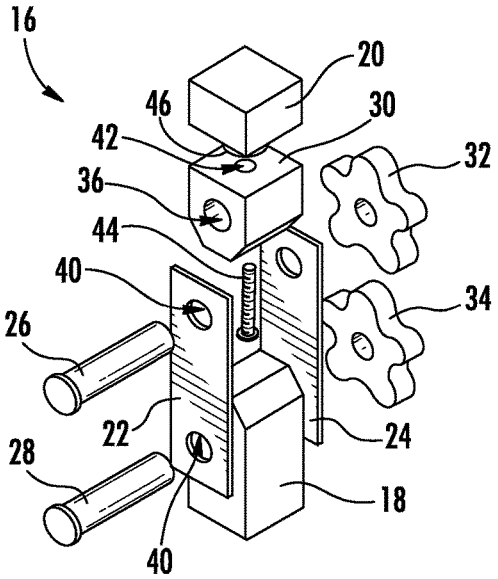
FIG. 2B is an expanded perspective view of the adjustment column depicted in FIG. 2A, illustrating, in particular, the base pivot post, platform post, platform pivot post, connecting plates, and knob assemblies, according to an embodiment of the technology described herein.
Figure 3A:
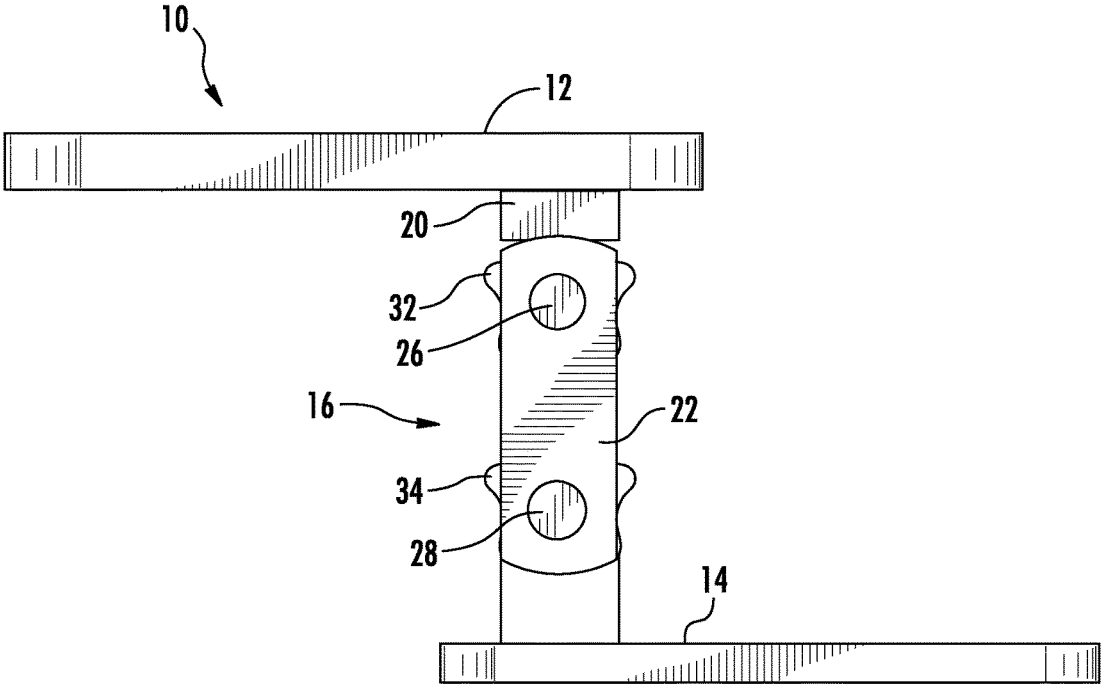
FIG. 3A is a left side view of the adjustable lap table depicted in FIG. 1A, according to an embodiment of the technology described herein.
Figure 3B:
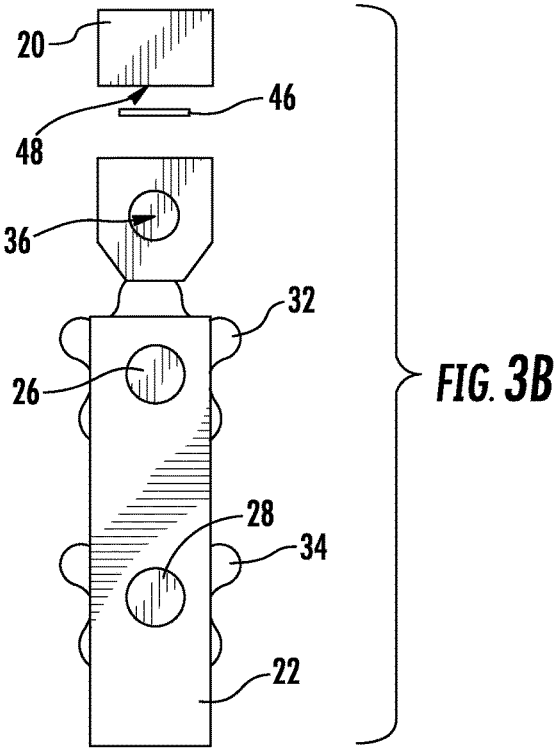
FIG. 3B is an expanded view of the adjustment column depicted in FIG. 3A, according to an embodiment of the technology described herein.
Figure 4A:
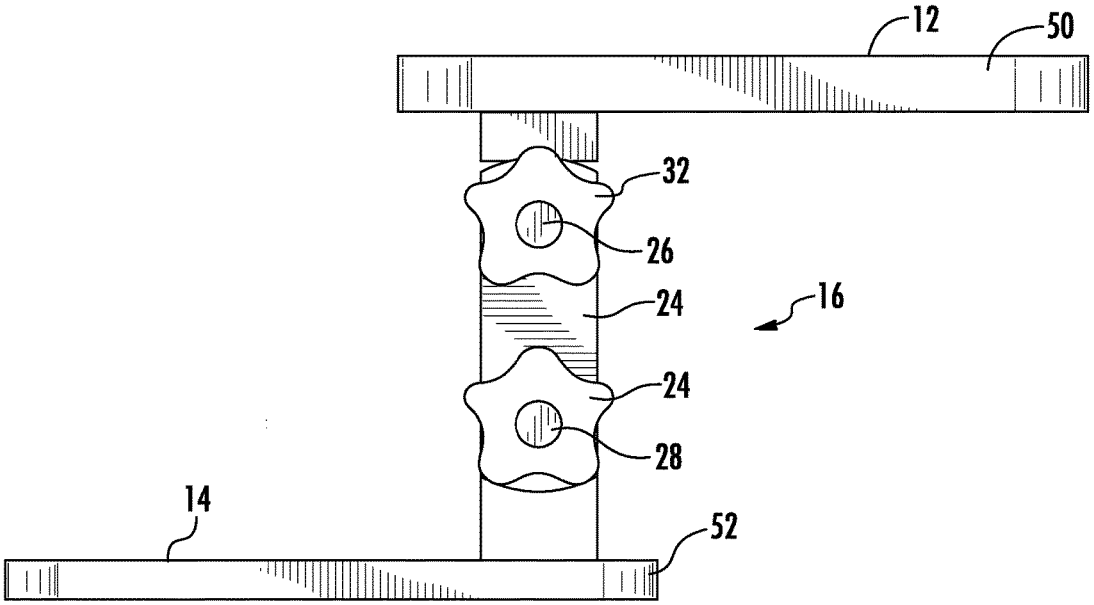
FIG. 4A is a right side view of the adjustable lap table depicted in FIG. 1A, according to an embodiment of the technology described herein.
Figure 4B:
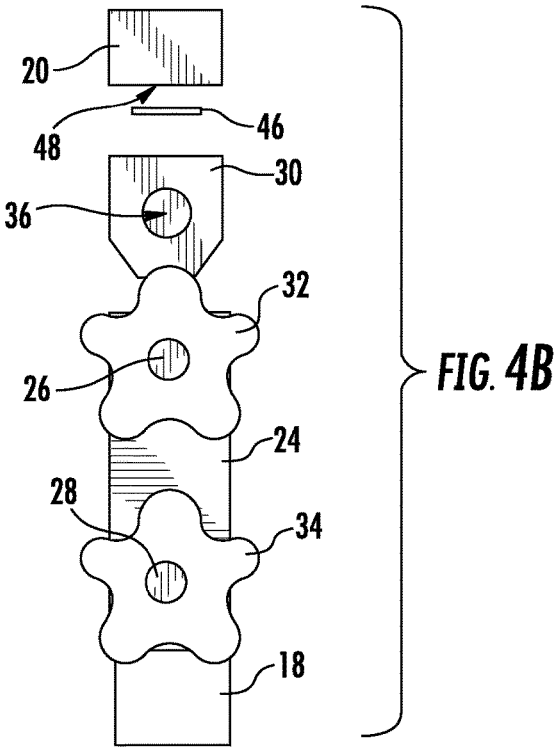
FIG. 4B is an expanded view of the adjustment column depicted in FIG. 4A, according to an embodiment of the technology described herein.
Figure 5A:
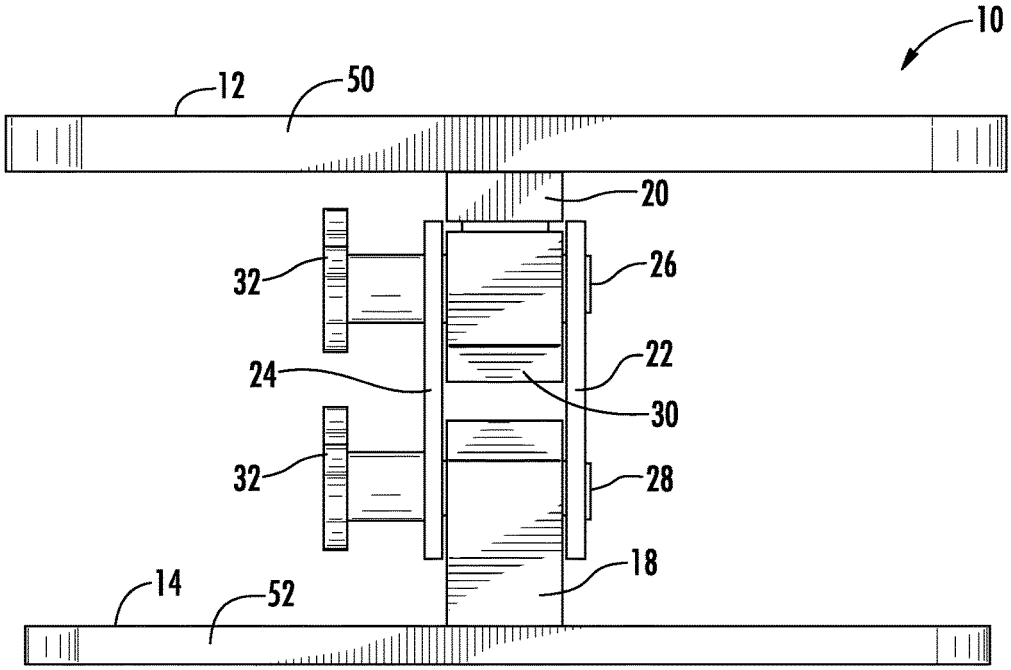
FIG. 5A is a back view of the adjustable lap table depicted in FIG. 1A, according to an embodiment of the technology described herein.
Figure 5B:
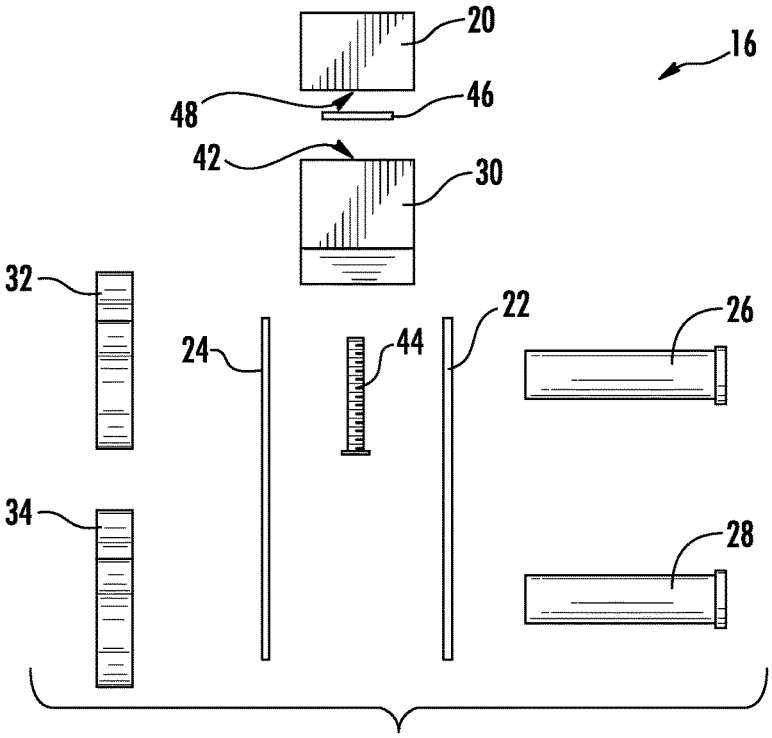
FIG. 5B is an expanded view of the adjustment column depicted in FIG. 5A, according to an embodiment of the technology described herein.
Figure 6A:
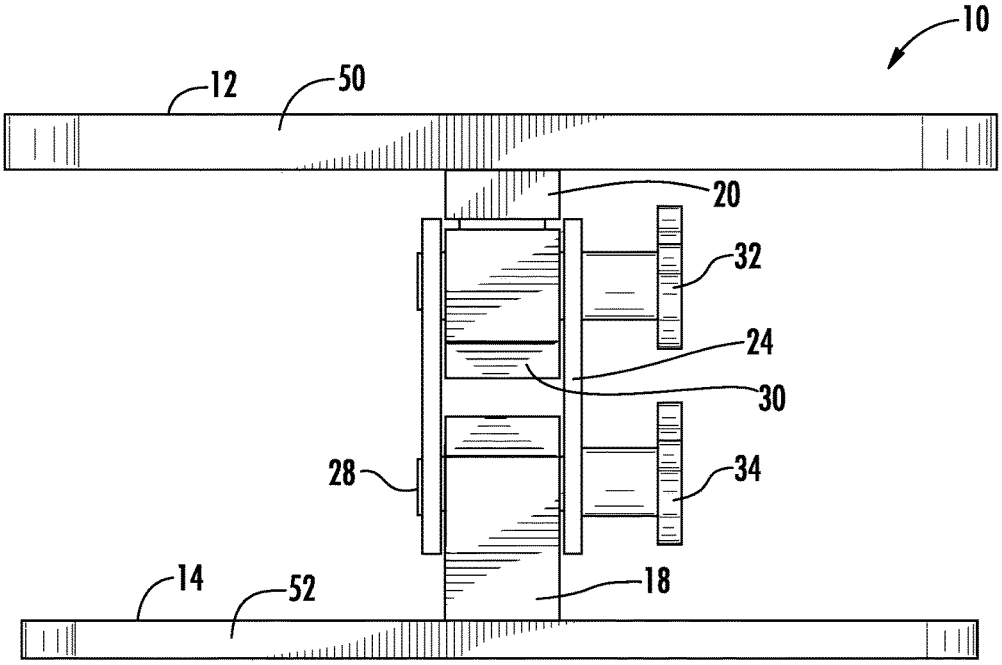
FIG. 6A is a front view of the adjustable lap table depicted in FIG. 1A, according to an embodiment of the technology described herein.
Figure 6B:
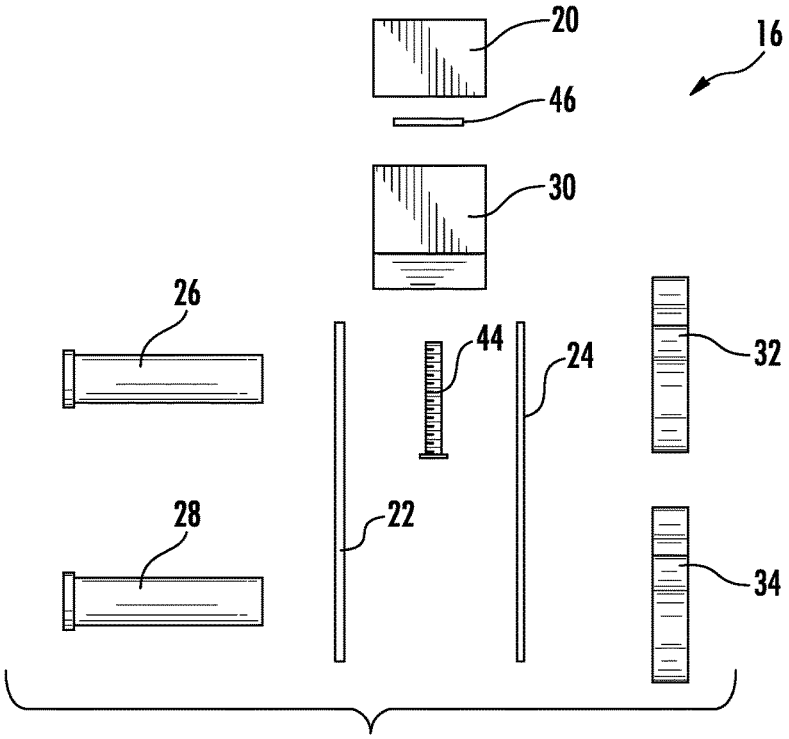
FIG. 6B is an expanded view of the adjustment column depicted in FIG. 6A, according to an embodiment of the technology described herein.
Figure 7A:
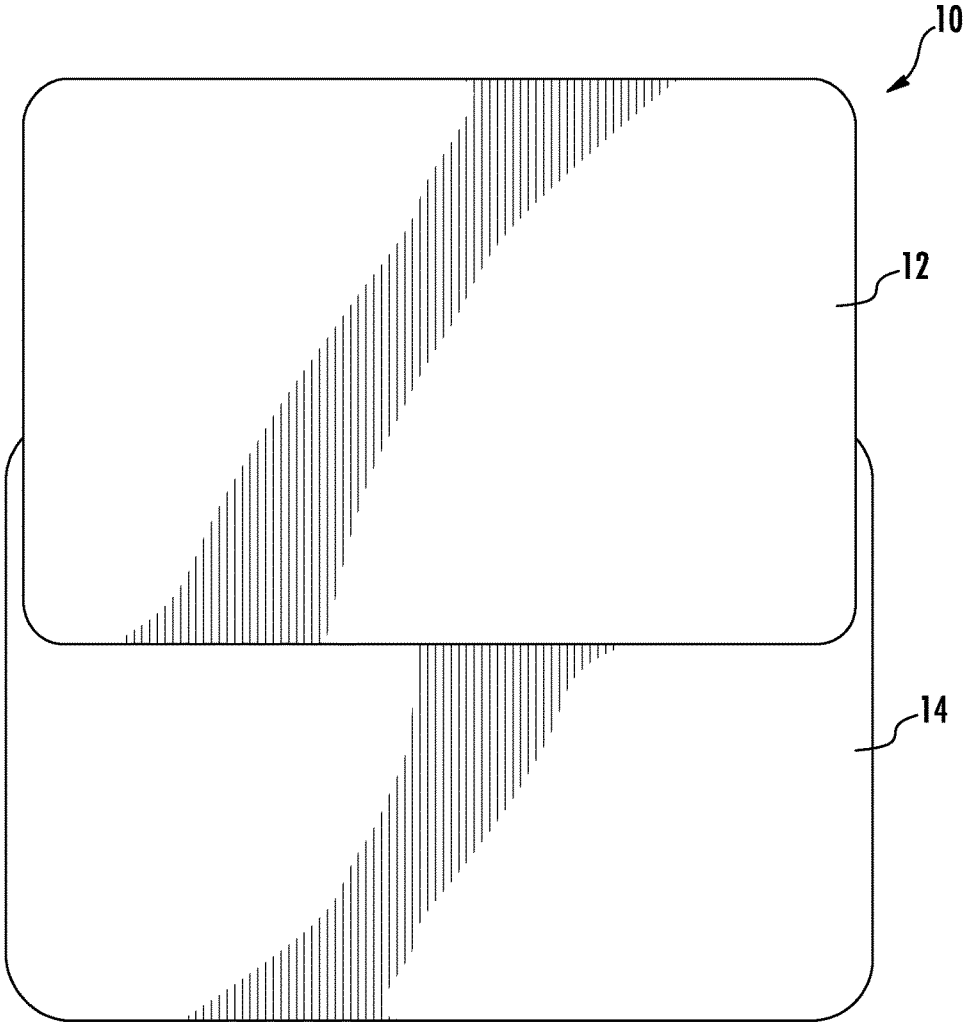
FIG. 7A is a bottom view of the adjustable lap table depicted in FIG. 1A, according to an embodiment of the technology described herein.
Figure 7B:
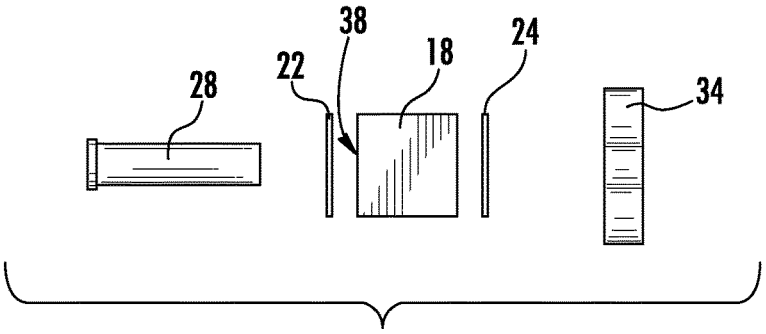
FIG. 7B is an expanded view of the adjustment column depicted in FIG. 7A, according to an embodiment of the technology described herein.
Figure 8A:
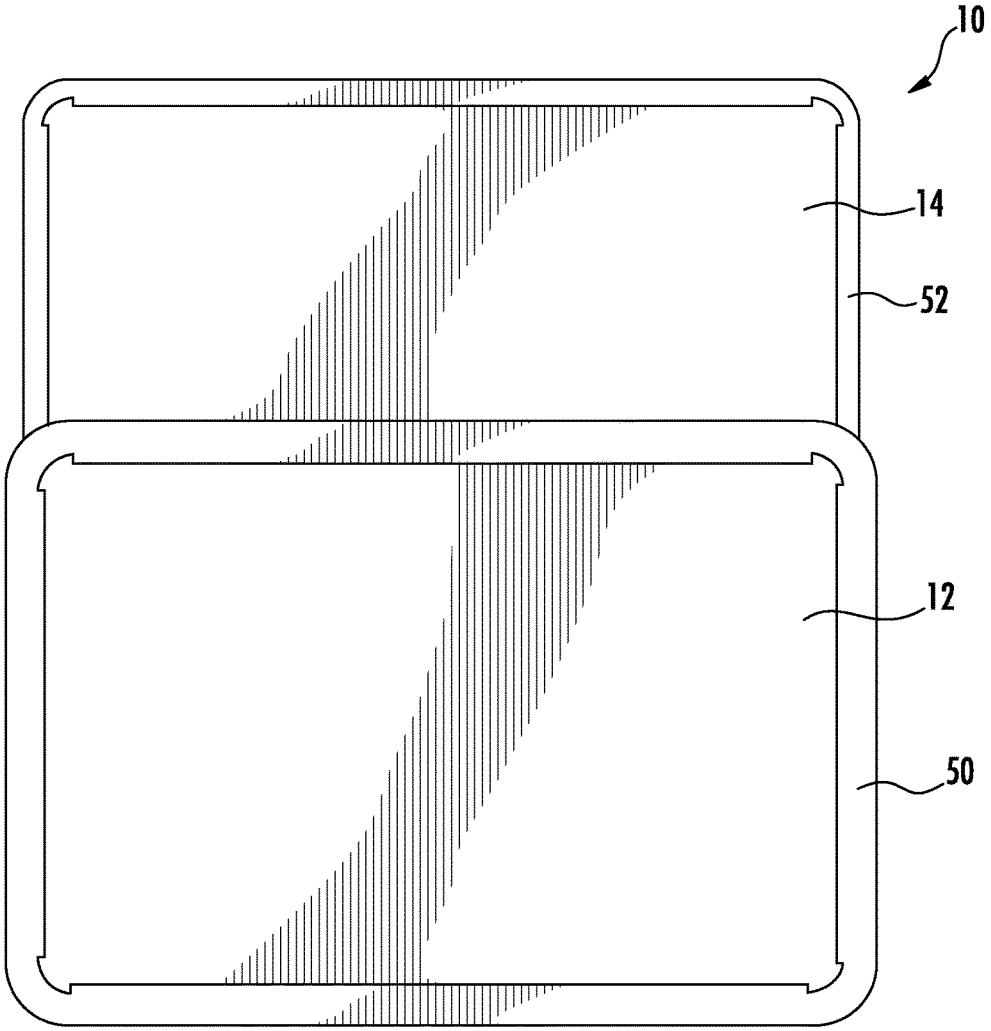
FIG. 8A is a top view of the adjustable lap table depicted in FIG. 1A, according to an embodiment of the technology described herein.
Figure 8B:
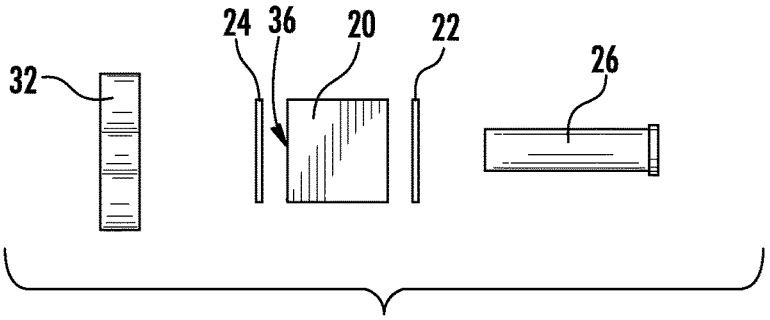
FIG. 8B is an expanded view of the adjustment column depicted in FIG. 8A, according to an embodiment of the technology described herein.

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides an adjustable and collapsible lap table. The lap table is adjustable in three dimensions and includes a top portion that is rotatable 360 degrees. The lap table is designed to accommodate and receive an electronic device, portable computer, e-reader, phone, or the like.

Referring now to the Figures, an adjustable lap table 10 is shown. The adjustable lap table 10 is collapsible, rotatable, and adjustable in three dimensions.

The adjustable lap table 10 includes a base 12. The base 12 is generally planar and rectangular and is configured for placement upon a user's lap or other flat surface without any additional mounting hardware. In at least one embodiment the base 12 is wood. In at least one embodiment, the base 12 is Baltic birch, a material to minimize bending and warping.

The adjustable lap table 10 includes a platform 14. The platform 14 is generally planar and rectangular and configured for receipt of an electronic device, book, or the like. The platform 14 is configured for use at a plurality of angles, orientations, and rotations relative to the base 12 of the lap table 10. In at least one embodiment the platform is wood. In at least one embodiment, the platform 14 is Baltic birch, a material to minimize bending and warping.

The adjustable lap table 10 includes an adjustment column assembly 16. The adjustment column assembly 16 is disposed between the base 12 and the platform 14. The adjustment column assembly 16 is coupled to the base 14 and the platform 12. The adjustment column assembly 16 provides a means to adjust the lap table 10 in three dimensions.

It at least one embodiment, the base does not have a protective band. In at least one embodiment, the adjustable lap table 10 also includes a base protective band 52. The base protective band 52 is disposed about an outer circumference of the base 12 to provide a soft edge of the base 12. In at least one embodiment, the base protective band 52 is a polymer.

In at least one embodiment, the adjustable lap table 10 also includes a platform protective band 50. The platform protective band 50 is disposed about an outer circumference of the platform 14 to provide a soft edge of the platform 14. In at least one embodiment, the platform protective band 50 is a polymer In at least one embodiment, the adjustable lap table 10 also includes a lip disposed upon a top edge of the platform protective band 50. As such the lip forms a tray on a top surface of the platform 12 and provides an edge against which an item on the platform 12 is maintained.

In at least one embodiment, the adjustment column assembly 16 also includes a base pivot post 18. The base pivot post 18 is disposed upon a top surface of the base 12 and provides a connectivity point for the base 14 to the adjustment column assembly 16. By way of example. The base pivot post 18 is disposed upon the base at a central back location on the top surface of the base 12. The base pivot post 18 includes a base pivot post channel 38. The base pivot post channel 38 is disposed within the base pivot post 18 in a generally horizontal arrangement and provides a first axis about which the lap table 10 is adjustable.

In at least one embodiment, the adjustment column assembly 16 further includes a platform post 20. The platform post 20 is disposed upon a bottom surface of the platform 12 and provides a connectivity point for the platform 12 to the adjustment column assembly 16.

In at least one embodiment, the adjustment column assembly 16 further includes a rotational disc 46. The rotational disc 46 includes a disc aperture in a center portion such that it can receive bolt 44, detailed below, and then rotate.

The platform post 20 further includes a platform post aperture 48. The platform post aperture 48 is disposed within the platform post 20 in a generally vertical arrangement. The platform post aperture 48 provides a second axis about which the lap table 10 is adjustable, thereby to provide 360 degrees of rotation of the platform 14 about the second axis.

In at least one embodiment, the adjustment column assembly 16 also includes a platform pivot post 30. The platform pivot post 30 is disposed immediately below the platform post 20. A platform pivot post horizontal channel 36 is disposed within the platform pivot post 30 in a generally horizontal arrangement and to provide a third axis about which the lap table 10 is adjustable. A platform pivot post vertical channel 42 is disposed with the platform pivot post 30 in a generally vertical arrangement and to provide a means to couple the platform pivot post 30 to the platform post 20 and maintain rotation about both the second axis and the third axis.

In at least one embodiment, the adjustment column assembly 16 further includes a bolt 44. The bolt 44 is disposed through the platform pivot post vertical channel 42 to secure the platform pivot post 30 to the platform post 20 in a manner that allows full 360-degree rotation of the platform post 20, and the platform 12 upon the platform post 20 about the second axis.

In at least one embodiment, the adjustment column assembly 16 is separable into multiple independent components, making the lap table 10 collapsible for ease in transport and to minimize space utilized.

In at least one embodiment, the adjustment column assembly 16 provides adjustability in three dimensions to include: up and down; front to back; and flat to pitched.

In at least one embodiment, the adjustment column assembly 16 further includes a left plate 22; a right plate 24; and a plurality of apertures 40 disposed through each of the left plate and the right plate. The left plate 22 and the right plate 24 are disposed about the left and right sides of both the base pivot post 18 and the platform pivot post 30, respectively, and wherein through the plates 22, 24 and apertures 40 the first knob post 26 and second knob post 28, respectively, are received.

In at least one embodiment, the adjustment column assembly 16 also includes a first knob post 26 and a first knob handle 32 to thread the platform pivot post horizontal channel 36 and by which a user tightens and loosens the first knob handle 32 to adjust the lap table 10 about the third axis.

In at least one embodiment, the adjustment column assembly 16 further includes a second knob post 28 and a second knob handle 34 to thread the base pivot post horizontal channel 38 and by which a user tightens and loosens the second knob handle 34 to adjust the lap table 10 about the first axis.

In various embodiments, one or more elements of the adjustment column assembly 16 are integrally formed.

Figure 9:
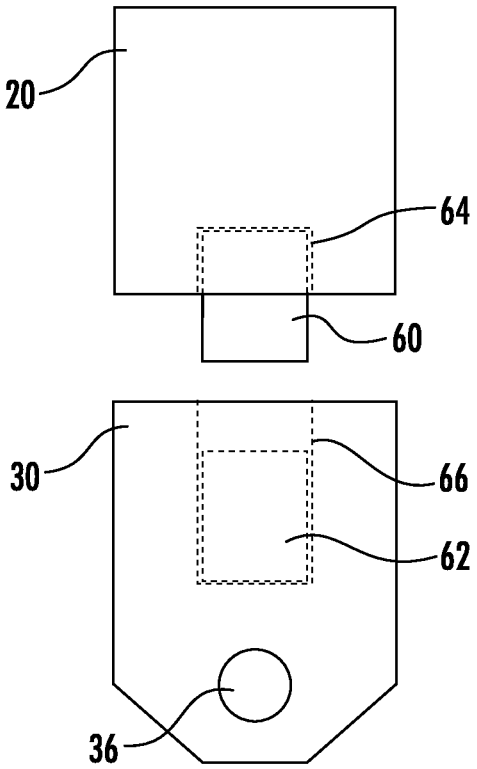
FIG. 9 is a schematic view of the platform post and the platform pivot post in an alternative embodiment with magnets, and illustrating, in particular a magnet within the platform post partially extended, and a magnet within the platform pivot post, according to an embodiment of the technology described herein.

In at least one embodiment, and with particular reference to FIG. 9, magnets are utilized to provide a means of coupling and rotation between the platform post 20 and the platform pivot post 30. As depicted in FIG. 9, platform post 20 includes a platform post magnet channel 64 into which platform post magnet 60 is placed. Platform pivot post 30 includes a platform pivot post magnet channel 66 into which platform pivot post magnet 62 is placed.

Magnets 60, 62 can be fully disposed within a post, or partially disposed within a post. As shown, the platform post magnet 64 is disposed approximately half of its length within the platform post magnet channel 64, with the other half of the magnet remaining extended outwardly. As shown the platform pivot post magnet 62 is fully embedded within the platform pivot post 30 and with a remaining area of the platform pivot post magnet channel 66 available for the portion of the platform post magnet 64 extended outwardly. By this means the magnets make contact one to another to provide a coupling, yet also provide a means to rotate within the channels such that the platform 14 can be rotated.

In at least one embodiment, the magnets 60, 62 are rare earth magnets. The magnets 60, 62 are strong, but they allow rotation, for example, of the platform 14 from portrait to landscape position.

In at least one embodiment, and by way of example and not of limitation, the magnets 60, 62 are cylindrical in shape and have height of 6 mm and diameter of 18 mm.

In at least one embodiment the platform post magnet channel 66 is 9 mm in depth. As such in can hold the platform post magnet 62 and leave 3 mm space remaining to receive one half of the platform post magnet 60 from the platform post 20.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

TABLE 1

| | |
|---|---|
| 10 | adjustable lap table |
| 12 | base |
| 14 | platform |
| 16 | adjustment column assembly |
| 18 | base pivot post |
| 20 | platform post |
| 22 | left plate |
| 24 | right plate |
| 26 | first knob post |
| 28 | second knob post |
| 30 | platform pivot post |
| 32 | first knob handle |
| 34 | second knob handle |
| 36 | platform pivot post horizontal channel |
| 38 | base pivot post horizontal channel |
| 40 | plate aperture |
| 42 | platform pivot post vertical channel |
| 44 | bolt |
| 46 | disc |
| 48 | platform post aperture |
| 50 | platform polymer band |
| 52 | base polymer band |
| 60 | platform post magnet |
| 62 | platform pivot post magnet |
| 64 | platform post magnet channel |
| 66 | platform pivot post magnet channel |

What is claimed is:

1. An adjustable lap table, collapsible, rotatable, and adjustable in three dimensions, the adjustable lap table comprising:

a base, generally planar in shape and configured for placement upon a user's lap or other flat surface without any additional mounting hardware;

a platform generally planar in shape and configured for receipt of an electronic device or book, and configured for use at a plurality of angles, orientations, and rotations relative to the base of the lap table;

an adjustment column assembly disposed between the base and the platform and coupled to the base and the platform, thereby to provide a means to adjust the lap table in three dimensions;

a base pivot post disposed upon a top surface of the base; and a base pivot post channel disposed within the base pivot post in a generally horizontal arrangement and to provide a first axis about which the lap table is adjustable.

2. The adjustable lap table of claim 1, further comprising:

a platform protective band disposed about an outer circumference of the platform to provide a soft edge of the platform.

3. The adjustable lap table of claim 2, further comprising:

a lip disposed upon a top edge of the platform protective band to form a tray on a top surface of the platform and to provide an edge against which an item on the platform is maintained.

4. The adjustable lap table of claim 2, wherein the platform protective band comprises a polymer.

5. The adjustable lap table of claim 1, wherein the adjustment column assembly further comprises:

a platform post disposed upon a bottom surface of the platform;

a rotational disc having a disc aperture in a center portion; and a platform post aperture disposed within the platform post in a generally vertical arrangement and to provide a second axis about which the lap table is adjustable, thereby to provide 360 degrees of rotation of the platform about the second axis.

6. The adjustable lap table of claim 5, wherein the adjustment column assembly further comprises:

a platform pivot post, disposed immediately below the platform post;

a platform pivot post horizontal channel disposed within the platform pivot post in a generally horizontal arrangement and to provide a third axis about which the lap table is adjustable; and a platform pivot post vertical channel disposed with the platform pivot post in a generally vertical arrangement and to provide a means to couple the platform pivot post to the platform post and maintain rotation about both the second axis and the third axis.

7. The adjustable lap table of claim 6, wherein the adjustment column assembly further comprises:

a bolt disposed through the platform pivot post vertical channel to secure the platform pivot post to the platform post in a manner that allows full 360-degree rotation of the platform post, and the platform upon the platform post about the second axis.

8. The adjustable lap table of claim 5, wherein the adjustment column assembly further comprises:

a platform post disposed upon a bottom surface of the platform;

a platform post magnet channel disposed within the platform post in a generally vertical arrangement and to provide a second axis about which the lap table is adjustable, thereby to provide 360 degrees of rotation of the platform about the second axis;

a platform post magnet disposed at least partially within the platform post magnet channel;

a platform pivot post, disposed immediately below the platform post;

a platform pivot post horizontal channel disposed within the platform pivot post in a generally horizontal arrangement and to provide a third axis about which the lap table is adjustable; and a platform pivot post magnet channel disposed with the platform pivot post in a generally vertical arrangement and to provide a means to couple the platform pivot post to the platform post and maintain rotation about both the second axis and the third axis; and a platform pivot post magnet disposed at least partially within the platform pivot post magnet channel;

wherein the platform post magnet and the platform pivot post magnet are magnetically and removably coupled to one another, yet allow for rotation.

9. The adjustable lap table of claim 1, wherein the adjustment column assembly is collapsible for ease in transport and to minimize space utilized.

10. The adjustable lap table of claim 1, wherein adjustment column assembly provides adjustability in three dimensions to include: up and down, front to back; and flat to pitched.

11. The adjustable lap table of claim 1, wherein the adjustment column assembly further comprises:

a platform post disposed upon a bottom surface of the platform;

a rotational disc having a disc aperture in a center portion;

a platform post aperture disposed within the platform post in a generally vertical arrangement and to provide a second axis about which the lap table is adjustable, thereby to provide 360 degrees of rotation of the platform about the second axis;

a platform pivot post, disposed immediately below the platform post;

a platform pivot post horizontal channel disposed within the platform pivot post in a generally horizontal arrangement and to provide a third axis about which the lap table is adjustable;

a platform pivot post vertical channel disposed with the platform pivot post in a generally vertical arrangement and to provide a means to couple the platform pivot post to the platform post and maintain rotation about both the second axis and the third axis;

a first knob post and a first knob handle to thread the platform pivot post horizontal channel and by which a user tightens and loosens the first knob handle to adjust the lap table about the third axis;

a base pivot post disposed upon a top surface of the base;

a base pivot post channel disposed within the base pivot post in a generally horizontal arrangement and to provide a first axis about which the lap table is adjustable; and a second knob post and a second knob handle to thread the base pivot post horizontal channel and by which a user tightens and loosens the second knob handle to adjust the lap table about the first axis.

12. The adjustable lap table of claim 11, wherein the adjustment column assembly further comprises:

a left plate;

a right plate;

a plurality of apertures disposed through each of the left plate and the right plate;

wherein the left plate and the right plate are disposed about the left and right sides of both the base pivot post and the platform pivot post, respectively, and wherein through the plates and apertures the first knob post and second knob post, respectively, are received.

13. The adjustable lap table of claim 1, wherein the base and platform are comprised of wood.

14. The adjustable lap table of claim 1, wherein the base and platform are comprised of injection molded plastic.

15. An adjustable lap table, collapsible, rotatable, and adjustable in three dimensions, the adjustable lap table comprising:

a base, generally planar in shape and configured for placement upon a user's lap or other flat surface without any additional mounting hardware;

a platform generally planar in shape and configured for receipt of an electronic device or book, and configured for use at a plurality of angles, orientations, and rotations relative to the base of the lap table;

a platform post disposed upon a bottom surface of the platform;

a rotational disc having a disc aperture in a center portion;

a platform post aperture disposed within the platform post in a generally vertical arrangement and to provide a second axis about which the lap table is adjustable, thereby to provide 360 degrees of rotation of the platform about the second axis;

a platform pivot post, disposed immediately below the platform post;

a platform pivot post horizontal channel disposed within the platform pivot post in a generally horizontal arrangement and to provide a third axis about which the lap table is adjustable;

a platform pivot post vertical channel disposed with the platform pivot post in a generally vertical arrangement and to provide a means to couple the platform pivot post to the platform post and maintain rotation about both the second axis and the third axis;

a first knob post and a first knob handle to thread the platform pivot post horizontal channel and by which a user tightens and loosens the first knob handle to adjust the lap table about the third axis;

a base pivot post disposed upon a top surface of the base;

a base pivot post channel disposed within the base pivot post in a generally horizontal arrangement and to provide a first axis about which the lap table is adjustable; and a second knob post and a second knob handle to thread the base pivot post horizontal channel and by which a user tightens and loosens the second knob handle to adjust the lap table about the first axis.

16. The adjustable lap table of claim 15, further comprising:

a bolt disposed through the platform pivot post vertical channel to secure the platform pivot post to the platform post in a manner than allows full 360-degree rotation of the platform post, and the platform upon the platform post about the second axis.

17. The adjustable lap table of claim 15, further comprising:

a platform protective band disposed about an outer circumference of the platform to provide a soft edge of the platform.

18. The adjustable lap table of claim 17, further comprising:

a lip disposed upon a top edge of the platform protective band to form a tray on a top surface of the platform and to provide an edge against which an item on the platform is maintained.

19. The adjustable lap table of claim 15, further comprising:

a left plate;

a right plate; and a plurality of apertures disposed through each of the left plate and the right plate;

wherein the left plate and the right plate are disposed about the left and right sides of both the base pivot post and the platform pivot post, respectively, and wherein through the plates and apertures the first knob post and second knob post, respectively, are received.

* * * * *